US006189688B1

(12) United States Patent
Aneas

(10) Patent No.: US 6,189,688 B1
(45) Date of Patent: Feb. 20, 2001

(54) MULTI-CHAMBER DISPENSING CONTAINER FOR STORING AT LEAST TWO SUBSTANCES, THE EXTEMPORANEOUS MIXTURE OF THESE SUBSTANCES, AND DISTRIBUTION OF THE MIXTURE

(75) Inventor: Antoine Aneas, Menetrol (FR)

(73) Assignee: Biodome, Issoire (FR)

( * ) Notice: Under 35 U.S.C. 154(b), the term of this patent shall be extended for 0 days.

(21) Appl. No.: 09/355,520

(22) PCT Filed: Jan. 30, 1998

(86) PCT No.: PCT/FR98/00177

§ 371 Date: Jul. 29, 1999

§ 102(e) Date: Jul. 29, 1999

(87) PCT Pub. No.: WO98/34842

PCT Pub. Date: Aug. 13, 1998

(30) Foreign Application Priority Data

Feb. 7, 1997 (FR) ..... 97 01633

(51) Int. Cl.[7] ..... B65D 25/08

(52) U.S. Cl. ..... 206/219; 206/221; 206/469; 215/DIG. 8

(58) Field of Search ..... 206/219, 221, 206/469, 568, 532; 215/DIG. 8

(56) References Cited

U.S. PATENT DOCUMENTS

| | | | | |
|---|---|---|---|---|
| 1,848,849 | * | 3/1932 | Stone | 222/577 |
| 2,653,611 | * | 9/1953 | Smith | 206/219 |
| 3,290,017 | * | 12/1966 | Davies et al. | 206/221 |
| 4,221,291 | * | 9/1980 | Hunt | 215/DIG. 8 |
| 4,875,577 | * | 10/1989 | Hildebrandt et al. | 206/219 |
| 5,088,627 | * | 2/1992 | Musel | 222/145.5 |
| 5,394,980 | * | 3/1995 | Tsai | 206/219 |

FOREIGN PATENT DOCUMENTS

| | | | |
|---|---|---|---|
| 1 262 088 | | 9/1961 | (FR) . |
| 2 654 076 A1 | | 5/1991 | (FR) . |
| 1107-863 | * | 8/1984 | (SU) ..... 206/219 |
| WO 91/00094 | | 1/1991 | (WO) . |

* cited by examiner

*Primary Examiner*—Paul T. Sewell
*Assistant Examiner*—Troy Arnold
(74) *Attorney, Agent, or Firm*—Oliff & Berridge, PLC

(57) ABSTRACT

A multi-chamber dispensing container for storing at least two substances in an impervious and sterile environment. The container has a tubular body, with a bottom end and an end having an opening. At least one means of occlusion having a continuous outer edge is disposed in an oblique position inside the body between the ends prior to activation of the container. The means of occlusion seals the body imperviously and divides it into two chambers, each containing a substance. The container further has a means for dispensing the substances contained in the body, these means being disposed near the end presenting the opening and sealing this end imperviously. The means of occlusion has two different areas, one of which is partially tearable under the effect of activating pressure from the fingers, the other being designed so as to not tear under the effect of the pressure. This second area maintains the means of occlusion in place within the body after activation.

8 Claims, 2 Drawing Sheets

MULTI-CHAMBER DISPENSING CONTAINER FOR STORING AT LEAST TWO SUBSTANCES, THE EXTEMPORANEOUS MIXTURE OF THESE SUBSTANCES, AND DISTRIBUTION OF THE MIXTURE

BACKGROUND OF THE INVENTION FIELD OF THE INVENTION

The present invention relates to a multi-chamber dispensing container for storing at least two substances which must be stored separately, the extemporaneous mixture thereof, and the dispensing of the mixture of these substances. The present invention will be more particularly described with respect to a dropper flask with two chambers, containing, sterile during storage, for example, a lyophilized powder in a first chamber, and a liquid in a second chamber, these two substances then being mixed extemporaneously in the container, and the mixture then being dispensed.

A multi-chamber dispensing container of the type mentioned hereinabove is known, described by International Patent Application published under No. WO-A-91/00094. This Application generally describes the use of a multi-chamber dispensing container for storing and, extemporaneously, dispensing a mixture of two liquids, in the present case a solution of papaverine sulfate and a basic solution such as bicarbonate of soda. It is necessary to separate the two solutions in order to prevent the precipitation of papaverine H during storage thereof. The two solutions are stored in a container body in the form of a rubber tube, presenting an end having an opening and a bottom end, in two chambers separated by a disc of plastics material. This disc is disposed perpendicularly to the container body and is of larger diameter than the inner diameter of the container body. In this way, the disc is maintained in place by the elastic hold of the container body on the peripheral edge thereof. Dispensing means are also provided in the vicinity of the end having an opening of the container body, hermetically closing said opening, and take the form of an injection needle. Before activation, i.e. during storage, the two liquids are therefore hermetically separated by the disc. Activation of the dispensing container is effected by a displacement of the disc caused by the pressure of the hand and thumb in a reciprocating movement on the body of the container. The disc is thus caused to drop into the bottom of the tube, and the two solutions can mix. The mixture is then dispensed by injection into the body through the needle.

However, such a container presents the following drawbacks:

- the pressure necessary for displacing the disc in order to be able to mix the two substances is high, as the diameter of said disc is larger than the inner diameter of the container body, the disc being, moreover, positively retained in the body via an annular groove provided on the inner wall of said container body;
- once disengaged, the disc may move freely in the tubular body, and, during dispensing of the mixture by injection, the body is inverted, which causes the disc to block at least partially the exit of the mixture via the needle.

SUMMARY OF THE INVENTION

The above-mentioned drawbacks raised a problem in that it was necessary to find a dispensing container similar to the one described previously but easier to actuate, and necessitating a lesser finger pressure, in order to facilitate its actuation for example by the elderly, and, at the same time, to avoid the separator disc blocking the exit of the product to be dispensed, once the container is actuated. The present invention proposes to solve this problem by providing a multi-chamber dispensing container for the tight storage, before activation, and the dispensing in the mixed state, after activation, of at least two substances, in particular a liquid and a lyophilized powder, said container comprising a substantially tubular container body, made of an elastically deformable material, presenting a bottom end, and an end having an opening, and at least one occlusion means presenting a continuous peripheral edge, disposed inside the container body, between the bottom end and the end having an opening, closing said body hermetically along its said peripheral edge, and dividing said body into at least two chambers, for the two substances respectively, the container further comprising means for dispensing the substances in the mixed state, disposed in the vicinity of the end having an opening, and hermetically closing same. The dispensing container according to the present invention is more particularly characterized in that, before activation of the container, the occlusion means is disposed obliquely in the substantially tubular body, and comprises at least a first peripheral area partially tearable under the effect of a transverse activating pressure from the fingers, and at least a second peripheral area, different from the first area, non-tearable under the effect of said activating pressure, maintaining the occlusion means in place in the tubular body after activation.

This solution presents the advantage that the pressure to be exerted by the user is reduced to a minimum, as it is possible to activate the occlusion means, and consequently mix the substances contained in the different chambers, by a simple, light pressure by the fingers on the container body. Furthermore, the non-tearable areas enable the occlusion means to allow the substances to pass from one chamber to the other, while avoiding the occlusion means blocking the exit of the mixture while it is being dispensed by the dispensing means.

According to a preferred embodiment of the present invention, the occlusion means may be constituted by the same material as that of the substantially tubular body.

According to another preferred embodiment of the invention, the first peripheral area of the occlusion means may be in the form of a part of the peripheral edge, of thickness reduced with respect to the central thickness of said occlusion means.

Advantageously, the second peripheral area of the occlusion means may comprise two bridges of material, constituting therebetween an axis of rotation for said occlusion means, during activation of the container, said axis of rotation being disposed perpendicularly to the direction of the transverse activating pressure of the fingers.

The occlusion means may preferably be substantially in the form of a disc.

The substantially tubular body preferably comprises, on its outer surface, a recess for a finger to grip above the occlusion means, and a recess for a finger to grip below said occlusion means.

In addition, the container may advantageously comprise a removable sleeve for blocking activation of the substantially tubular container body, made of a material which is not elastically deformable, which surrounds said body at least at the level of the occlusion means.

The dispensing means are preferably integrated in or mounted on the container body, and are constituted by a nose of substantially truncated shape provided with a dropper.

In a preferred form of embodiment of the present invention, the container may comprise a removable cap for protecting the dispensing means, comprising at least one element for elastic hold with the container body and/or with the dispensing means, and an element forming stopper of said dispensing means, disposed inside the cap.

BRIEF DESCRIPTION OF THE DRAWINGS

The invention will be more readily understood from the detailed description of a preferred embodiment, given solely by way of illustration, reference usefully being made to the accompanying drawings, in which.

DETAILED DESCRIPTION OF PREFERRED EMBODIMENT

Figure 1:
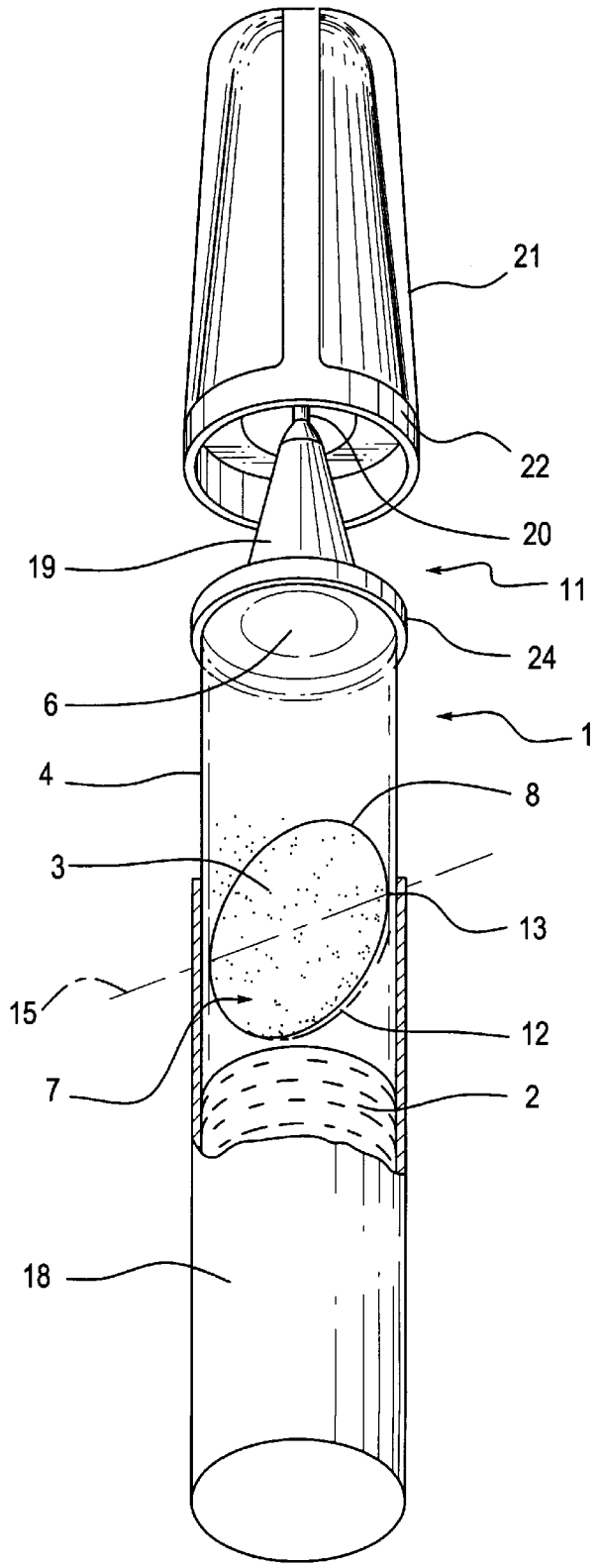
FIG. 1 shows a view in perspective, with parts torn away, of a dispensing container according to a preferred embodiment of the present invention.

According to FIGS. 1 to 4, a multi-chamber dispensing container 1 according to a preferred form of embodiment of the invention comprises a substantially tubular container body 4 made of an elastically deformable material, therefore relatively supple, for example made of low-density polyethylene or polypropylene. The body 4 presents a bottom end 5, closed for example by a stopper 5*a*, and an end 6 having an opening, as well as an occlusion means 7, which hermetically divides the body 4 into two chambers 9, 10. In order to facilitate hold of the container by the user, as well as the direction of the activating pressure, the body 4 may comprise, on its outer surface, a recess 16 for a finger to grip above the occlusion means 7, and a recess 17 for a finger to grip below said occlusion means 7.

In this preferred embodiment, chamber 9 contains a liquid 2, and chamber 10 a powder 3, for example lyophilized, but it is obvious that the two substances may also be combinations, for example of two or more liquids, or of two powders, or even that chamber 10 contains a liquid 2 and chamber 9 contains a powder 3. The container 1 further comprises means 11 for dispensing the substances 2, 3 in the mixed state, disposed in the vicinity of the end 6 having an opening, and closing the latter hermetically, and which will be described in greater detail hereinafter.

Figure 2:
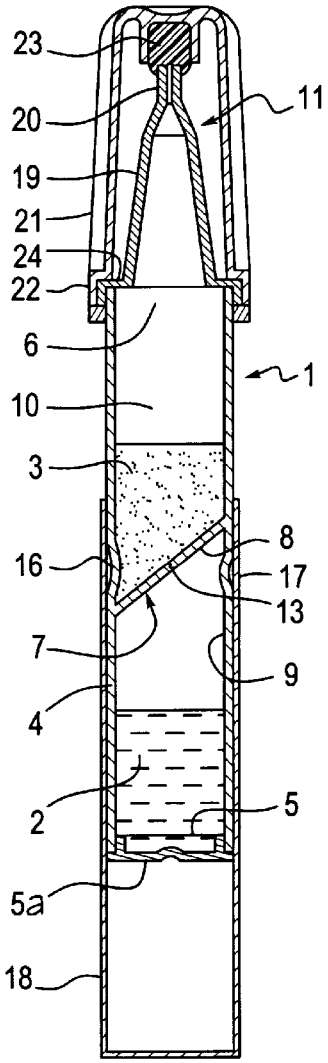
FIG. 2 shows a view in section of the container of FIG. 1 during storage of a lypophilized powder and a liquid, which are both sterile.

In accordance with FIGS. 1 and 2, the occlusion means 7 presents a continuous peripheral edge 8, disposed inside the body 4 of the container, between the bottom end 5 and the end 6 having an opening, closing the body 4 hermetically along its peripheral edge 8. In this way, before activation of the occlusion means by the user, the two substances cannot come into contact with each other, and are effectively stored in hermetic manner. This makes it possible to store in the same container for a long period of time substances in the separated state which are relatively unstable when they come into contact with one another, which is the case for example of several medicaments. Still before activation of the container 1, the occlusion means 7 is disposed obliquely in the body 4, and comprises a first peripheral area 12 partially tearable under the effect of a transverse activating pressure of the fingers, and a second peripheral area 13, different from the first area 12, untearable under the effect of the activating pressure, maintaining the occlusion means 7 in place in the tubular body 4 after activation.

Preferably but not obligatorily, the occlusion means 7 is constituted by the same material as that of the substantially tubular body, therefore for example of low-density polyethylene or polypropylene. In the case of the preferred form of embodiment according to the Figures , the occlusion means is substantially in the form of a disc, for example circular or elliptic, but this shape may, of course, vary as a function of the circumferential shape of the container body 4, and may for example be of polygonal shape.

Figure 4:
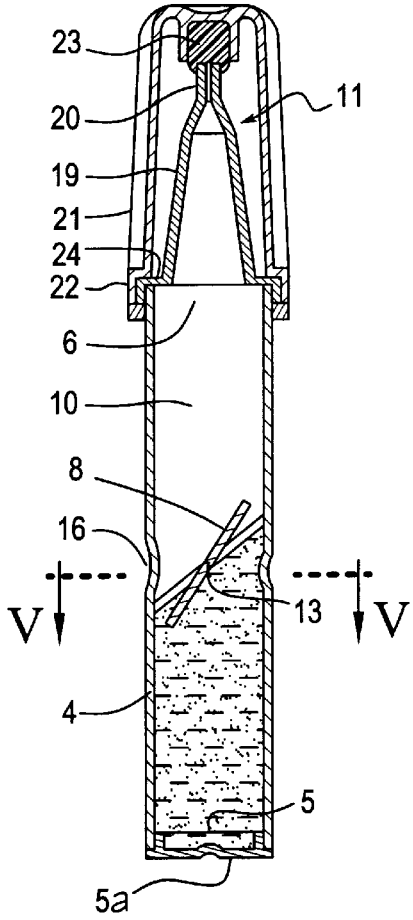
FIG. 4 shows a view in section of the container of FIG. 1 after activation and release of the occlusion means, and mixture of the substances.
Figure 5:
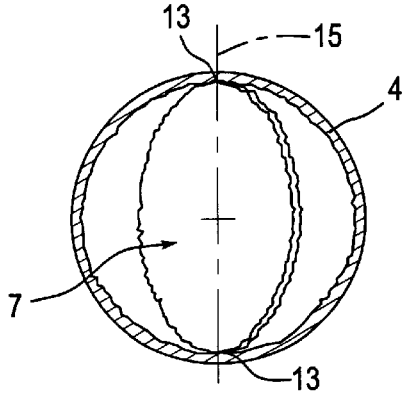
FIG. 5 shows a view in section along line V—V of FIG. 4, showing the position of the occlusion means after activation and mixture of the substances.

In the preferred embodiment illustrated by the Figures, the first peripheral area 12 of the disc 7 is in the form of a part of the peripheral edge 8, of reduced thickness with respect to the central thickness of the disc 7, and the second peripheral area 13 comprises two bridges of material, for example thicker than the thickness of the disc 7, constituting therebetween an axis of rotation 15 for the latter, during activation of the container 1. As shown in FIG. 5, which is a view in section along line V—V of FIG. 4, the axis of rotation 15 is disposed perpendicularly to the direction of the transverse activating pressure of the fingers, so as to oblige the rotation of the disc to be made in the direction of the activating force.

Furthermore, the container comprises dispensing means 11, in particular integrated in or mounted on the body 4, for example by irreversible, tight clipping or by welding or moulding in one piece. In the embodiment, the dispensing means are constituted by a nose 19 of substantially truncated shape provided with a dropper 20, provided at its proximal end, i.e. at the level of the end 6 of the body 4 having an opening, with an annular flange 24 fixed for example by welding to the body 4 along the perimeter of the latter. The dispensing means 11 may also be covered with a cap 21, internally comprising a stopper 23, adapted to receive and obturate the dropper 20 of the nose 19, and elements 22 for elastic hold with the body 4 of the container 1 and/or with the dispensing means 11. These elastic hold elements may be constituted for example by elastic teeth which reversibly clip on and around the annular flange 24 of the dispensing means 11.

In order to prevent an accidental activation of the container, the latter may in addition comprise a removable sleeve 18 for blocking activation of the body 4, made of a material which is not elastically deformable, which surrounds said body 4 at least at the level of the occlusion means 7. In this case, the sleeve 18 is preferably made of a more rigid material than that constituting the body 4, for example of low-density polyethylene or polypropylene, so as to resist any pressure of the fingers or the hand exerted on the container. As illustrated in FIG. 1, this sleeve 18 covers, starting from the bottom end 5, the recesses 16, 17 for grip and the body 4 up to the level of the disc 7, effectively preventing any inadvertent activation by the user.

Figure 3:
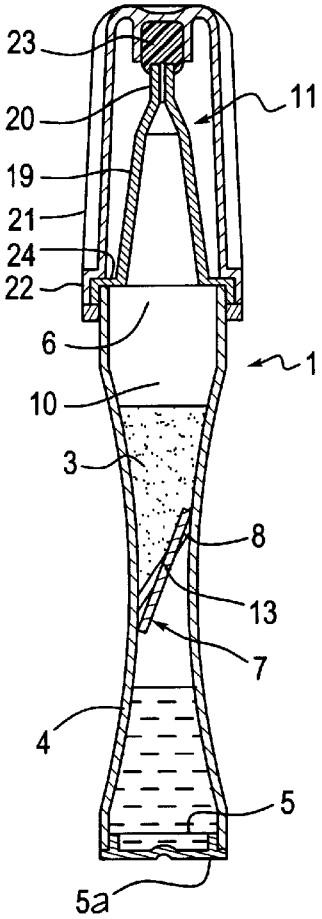
FIG. 3 shows a view in section of the container of FIG. 1 during activation and release of the occlusion means.

Functioning of the dispensing container 1 will now be described with reference to FIGS. 2 to 4. Before activation, the sleeve 18 is in place, as well as the cap 21 (cf. FIG. 2). The sleeve 18 is then withdrawn downwardly, exposing the body 4 of the container, and the recesses 16, 17 for grip. A slight activating pressure is exerted on the recesses by the user's fingers, which provokes tear of the peripheral area 12 at the level of this pressure, the disc 7 maintained by the bridges 13 then rotating so as to create an opening on either side of the axis 15, allowing the substances to be mixed (cf. FIGS. 3 and 4), either by shaking the container or by repeatedly pressing with the fingers on the body of the container. The cap is then removed and the mixture may be dispensed by the dispensing means 11 constituted by the nose 19 and the dropper 20. After the mixture has been dispensed, the cap may be replaced by clipping on the dispensing means 11, up to subsequent use.

What is claimed is:

1. Multi-chamber dispensing container for the tight storage, before activation, and the dispensing in the mixed state, after activation, of at least two substances, said container comprising:

a substantially tubular container body, made of an elastically deformable material, having a bottom end, and an end having an opening;

at least one occlusion means presenting a continuous peripheral edge, disposed inside the container body, between the bottom end and the end having an opening, closing the substantially tubular container body hermetically along its said peripheral edge, and dividing the substantially tubular container into at least two chambers, for the at least two substances respectively;

means for dispensing the substances in the mixed state, disposed in the vicinity of the end having an opening, hermetically closing the end having an opening, wherein, before activation of the container, the occlusion means is disposed obliquely in the substantially tubular body, and comprises:

at least one first peripheral area partially tearable under the effect of a transverse activating pressure from the fingers;

at least one second peripheral area, different from the first area, non-tearable under the effect of said activating pressure, maintaining the occlusion means in place in the tubular body after activation; and a removable sleeve for blocking activation of the substantially tubular container body, made of material which is not electrically deformable, which surrounds said body at least at the level of the inclusion means.

2. Multi-chamber dispensing container according to claim 1, wherein the occlusion means is constituted by the same material as that of the substantially tubular body.

3. Multi-chamber dispensing container according to claim 1, wherein the first peripheral area of the occlusion means is in the form of a part of the peripheral edge having a thickness less than a central thickness of said occlusion means.

4. Multi-chamber dispensing container according to claim 1 wherein the second peripheral area of the occlusion means comprises two bridges of material, constituting therebetween an axis of rotation for said occlusion means, during activation of the container, said axis of rotation being disposed perpendicularly to the direction of the transverse activating pressure of the fingers.

5. Multi-chamber dispensing container according to claim 1 wherein the occlusion means is substantially in the shape of a disc.

6. Multi-chamber dispensing container according to claim 1 wherein the substantially tubular body comprises, on its outer surface, a recess for a finger to grip above the occlusion means, and a recess for a finger to grip below said occlusion means.

7. Multi-chamber dispensing container according to claim 1 wherein the dispensing means is integrated in or mounted on the body of the container, and is constituted by a nose or substantially truncated shape provided with a dropper.

8. Multi-chamber dispensing container according to claim 1 further comprising a removable cap for protecting the dispensing means, comprising at least one element for elastic hold with at least one of the body of the container and the dispensing means; and an element forming a stopper for said dispensing means disposed inside the cap.

* * * * *

UNITED STATES PATENT AND TRADEMARK OFFICE

CERTIFICATE OF CORRECTION

PATENT NO. : 6,189,688 B1
DATED : February 20, 2001
INVENTOR(S) : Antoine Aneas

It is certified that error appears in the above-identified patent and that said Letters Patent is hereby corrected as shown below:

Column 6, claim 1,
Line 1,change "not electrically deformable" to -- not elastically deformable --.

Signed and Sealed this

Ninth Day of April, 2002

*Attest:*

*Attesting Officer*

JAMES E. ROGAN
*Director of the United States Patent and Trademark Office*